US011874067B2

(12) United States Patent
Liu

(10) Patent No.: US 11,874,067 B2
(45) Date of Patent: Jan. 16, 2024

(54) HEAT DISSIPATION UNIT WITH AXIAL CAPILLARY STRUCTURE

(71) Applicant: ASIA VITAL COMPONENTS (CHINA) CO., LTD., Shenzhen (CN)

(72) Inventor: Han-Min Liu, Shenzhen (CN)

(73) Assignee: ASIA VITAL COMPONENTS (CHINA) CO., LTD, Shenzhen (CN)

( * ) Notice: Subject to any disclaimer, the term of this patent is extended or adjusted under 35 U.S.C. 154(b) by 177 days.

(21) Appl. No.: 16/452,547

(22) Filed: Jun. 26, 2019

(65) Prior Publication Data

US 2020/0378690 A1 Dec. 3, 2020

(51) Int. Cl.
*F28D 15/04* (2006.01)

(52) U.S. Cl.
CPC ..... *F28D 15/04* (2013.01)

(58) Field of Classification Search
CPC combination set(s) only.
See application file for complete search history.

(56) References Cited

U.S. PATENT DOCUMENTS 3,651,240 A * 3/1972 Kirkpatrick ..... F27D 11/06 392/394
4,003,427 A * 1/1977 Leinoff ..... F28D 15/046 165/104.26
6,738,257 B1 * 5/2004 Lai ..... F28D 15/0266 165/104.26
10,677,535 B1 * 6/2020 Kawabata ..... H01L 23/427
10,677,536 B2 * 6/2020 Cai ..... F28D 15/02
2009/0020268 A1 * 1/2009 Chang ..... B23P 15/26 165/104.26
2009/0025910 A1 * 1/2009 Hoffman ..... F28D 15/046 165/104.21
2009/0151906 A1 * 6/2009 Lai ..... F28D 15/046 165/104.26

(Continued)

FOREIGN PATENT DOCUMENTS

TW M493032 1/2015
TW M517314 2/2016
TW M584883 10/2019

OTHER PUBLICATIONS

Search Report dated Sep. 19, 2019 issued by Taiwan Intellectual Property Office for counterpart application No. 108118290.

(Continued)

*Primary Examiner* — Devon Russell
(74) *Attorney, Agent, or Firm* — Demian K. Jackson; Jackson IPG PLLC

(57) ABSTRACT

A heat dissipation unit with axial capillary structure includes a case and at least one tubular body. The case has an internal case chamber and at least one opening in communication with the case chamber. A case capillary structure is formed in the case chamber. The tubular body has at least one axial capillary structure, an open end and a closed end. The open end and the closed end together define a tubular body chamber in communication with the open end. The axial capillary structure is disposed in the tubular body and the open end is plugged in the opening. The axial capillary structure directly abuts against and connects with the case capillary structure disposed on the bottom side of the case in the case. The heat dissipation unit with axial capillary structure is able to achieve better capillary transfer effect.

6 Claims, 7 Drawing Sheets

(56) References Cited

U.S. PATENT DOCUMENTS

| | | | | |
|---|---|---|---|---|
| 2011/0174464 | A1* | 7/2011 | Liu | F28D 15/046 29/890.032 |
| 2011/0303392 | A1* | 12/2011 | Horiuchi | F28D 15/046 165/104.26 |
| 2017/0153066 | A1* | 6/2017 | Lin | F28F 1/32 |
| 2017/0176112 | A1* | 6/2017 | Sarraf | F28D 15/02 |
| 2017/0227298 | A1* | 8/2017 | Sun | F28D 15/04 |
| 2017/0343296 | A1* | 11/2017 | Lan | F28D 15/0233 |
| 2017/0343298 | A1* | 11/2017 | Lan | F28D 15/0266 |
| 2017/0363367 | A1* | 12/2017 | Yeh | F28D 15/0233 |
| 2019/0132992 | A1* | 5/2019 | Farshchian | H05K 7/20336 |
| 2019/0242655 | A1* | 8/2019 | Tseng | F28D 15/046 |

OTHER PUBLICATIONS

Search Report dated Apr. 13, 2020 issued by Taiwan Intellectual Property Office for counterpart application No. 108118290.

* cited by examiner

HEAT DISSIPATION UNIT WITH AXIAL CAPILLARY STRUCTURE

This application claims the priority benefit of Taiwan patent application number 108118290 filed on May 27, 2019.

BACKGROUND OF THE INVENTION

1. Field of the Invention

The present invention relates generally to a heat dissipation unit with axial capillary structure, and more particularly to a heat dissipation unit with axial capillary structure, which is able to achieve better capillary transfer effect.

2. Description of the Related Art

The operation speed of the electronic components has become higher and higher. As a result, the heat generated by the electronic components has become higher and higher. To solve the heat dissipation problem of the electronic components, heat pipes and vapor chambers with good heat conductivity are widely applied to the electronic components. The vapor working fluid in the heat pipe can flow in a unified direction. However, the heat pipe has a limited volume so that the heat conducted by the heat pipe is quite limited. Moreover, the vapor chamber has a wider heated area for directly attaching to a heat source to conduct the heat generated by the heat source. However, the vapor working fluid in the vapor chamber flows in quite random directions so that the heat conduction and dissipation performance of the vapor chamber is limited.

Some manufacturers combine the conventional vapor chamber and heat pipe. The heat pipe is uprightly disposed on the vapor chamber with the internal chambers of the heat pipe and the vapor chamber in communication with each other. In addition, a tubular wall capillary structure is disposed on the entire inner circumference of the chamber of the heat pipe. The capillary structure is formed of sintered powder body or woven mesh. A plate wall capillary structure formed of sintered powder body or woven mesh is also formed on the upper and lower inner walls of the chamber of the vapor chamber. The sintered powder body or the woven mesh of the tubular wall capillary structure on the inner circumference of the heat pipe defines multiple voids, which provide capillary attraction to suck the condensed working fluid and make the condensed working fluid flow back to the plate wall capillary structure on the upper and lower inner walls of the chamber of the vapor chamber. Accordingly, the vapor-liquid circulation can be continuously repeatedly performed to dissipate the heat. However, there is a problem in such structure. That is, after cooled, the cooled working fluid (the liquid working fluid) will be absorbed by the sintered powder body or the woven mesh of the tubular wall capillary structure on the inner circumference of the heat pipe under the capillary attraction of the multiple voids. As a result, the liquid working fluid will gradually randomly spread over the entire inner circumference of the heat pipe. Also, the liquid working fluid will gradually downward flow along the inner circumference of the heat pipe in random directions back to the plate wall capillary structure on the upper and lower inner walls of the chamber of the vapor chamber.

Therefore, the cooled liquid working fluid cannot quickly flow back to the vapor chamber so that the problem of dry burn may take place due to insufficiency of the working fluid. Accordingly, the tubular wall capillary structure formed of sintered powder body and/or woven mesh in the conventional heat pipe can only provide capillary attraction to slowly transfer the liquid working fluid. As a result, as a whole, the capillary transfer efficiency is poor and the heat dissipation effect is poor.

SUMMARY OF THE INVENTION

It is therefore a primary object of the present invention to provide a heat dissipation unit with axial capillary structure, which is able to achieve better capillary transfer effect and enhance the heat dissipation efficiency.

It is a further object of the present invention to provide the above heat dissipation unit with axial capillary structure, in which a case capillary structure is formed in a case and an axial capillary structure is disposed on the inner circumference of at least one tubular body. The axial capillary structure is connected with the case capillary structure. Under the axial capillary attraction of the axial capillary structures, a cooled working fluid (liquid working fluid) will quickly axially flow back into the case. Accordingly, the working fluid can more efficiently flow in axial direction to achieve better heat dissipation effect.

To achieve the above and other objects, the heat dissipation unit with axial capillary structure of the present invention includes a case and at least one tubular body. The case has a case chamber and at least one opening. A working fluid is filled in the case chamber. A case capillary structure is formed in the case chamber. The at least one opening is formed through a top side of the case in communication with the case chamber. The at least one tubular body has at least one axial capillary structure, an open end and a closed end opposite to the open end. The open end and the closed end together define a tubular body chamber. The open end is in communication with the tubular body chamber and the case chamber. The axial capillary structure is disposed in the tubular body and distributed in the longitudinal direction of the tubular body. The open end of the tubular body is plugged in the at least one opening. The axial capillary structure directly abuts against and connects with the case capillary structure disposed on the bottom side of the case in the case chamber. By means of the axial capillary structure of the heat dissipation unit, the working fluid can more efficiently flow in axial direction to achieve better capillary transfer effect and enhance the heat dissipation efficiency.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
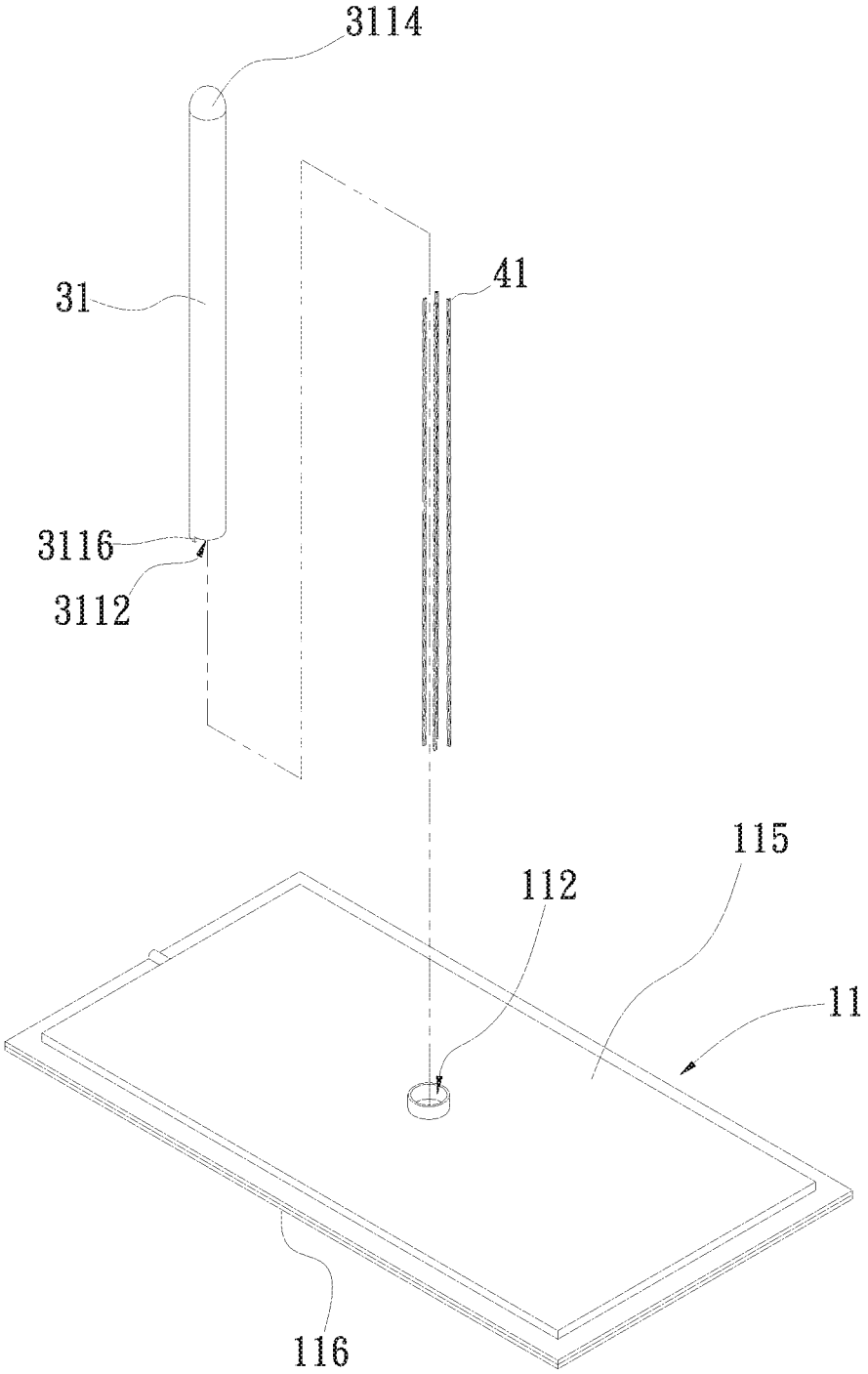
FIG. 1 is a perspective exploded view of a first embodiment of the present invention.
Figure 2:
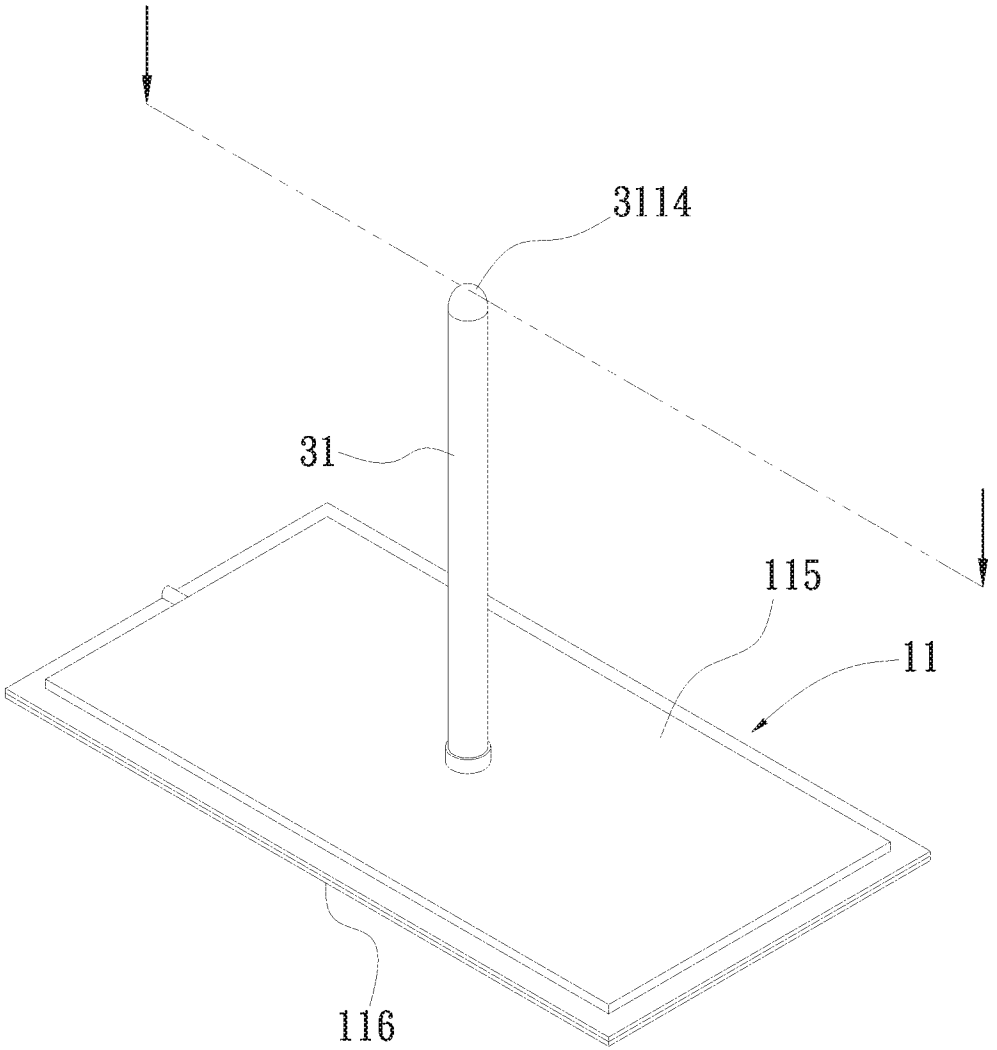
FIG. 2 is a perspective assembled view of the first embodiment of the present invention.
Figure 2A:
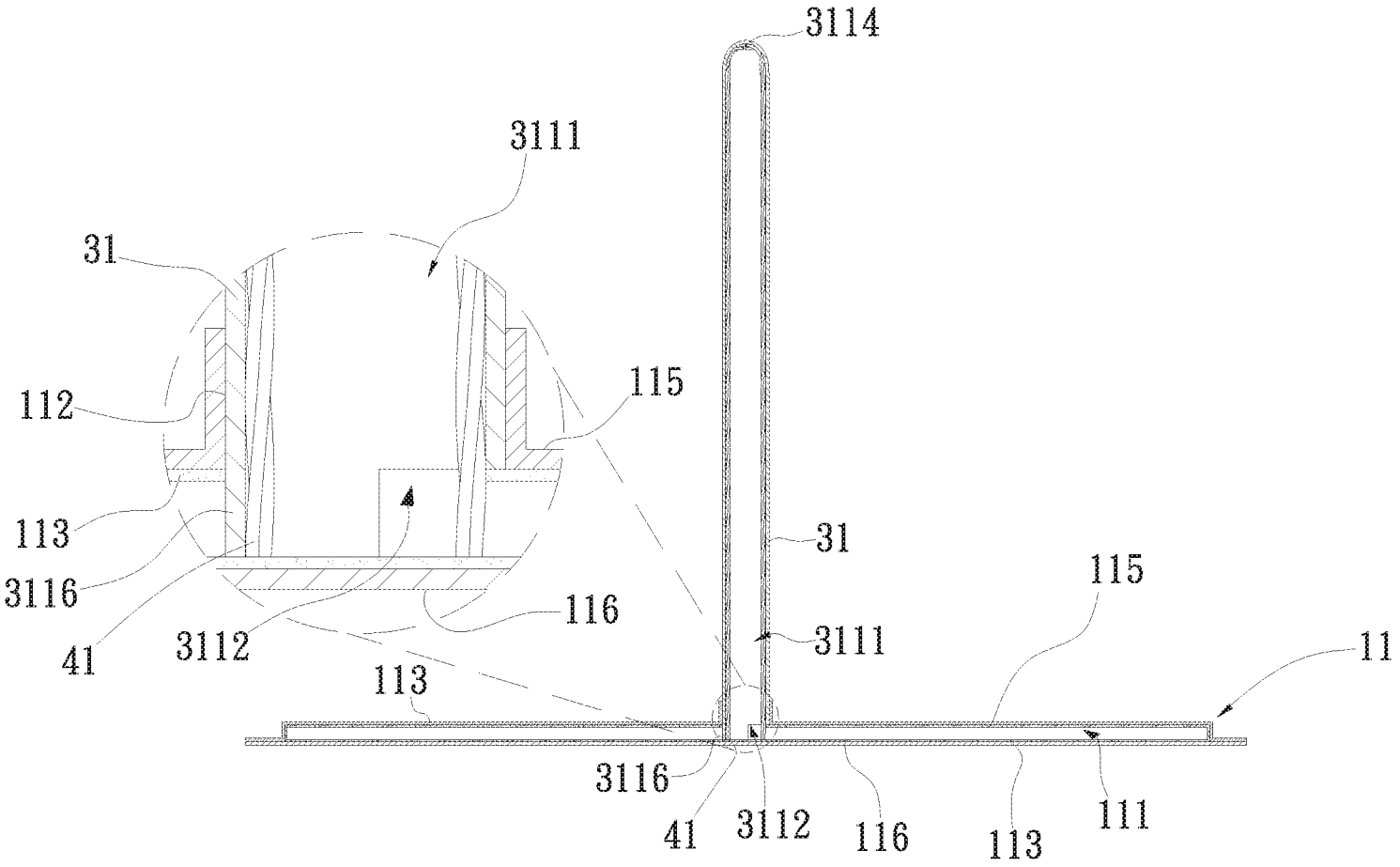
FIG. 2A is a sectional assembled view of the first embodiment of the present invention.
Figure 2B:
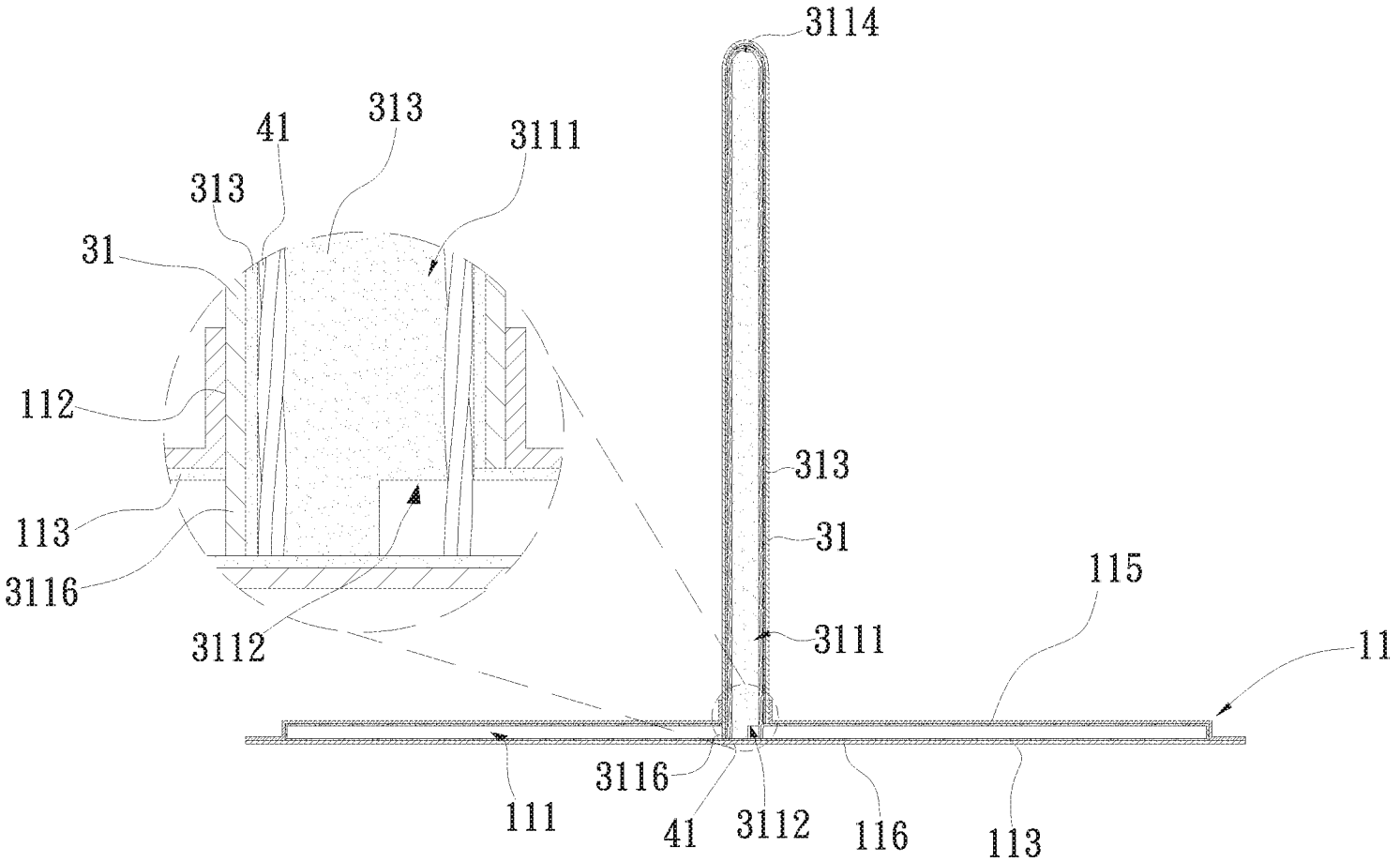
FIG. 2B is a sectional assembled view of a modified embodiment of the first embodiment of the present invention.
Figure 2C:
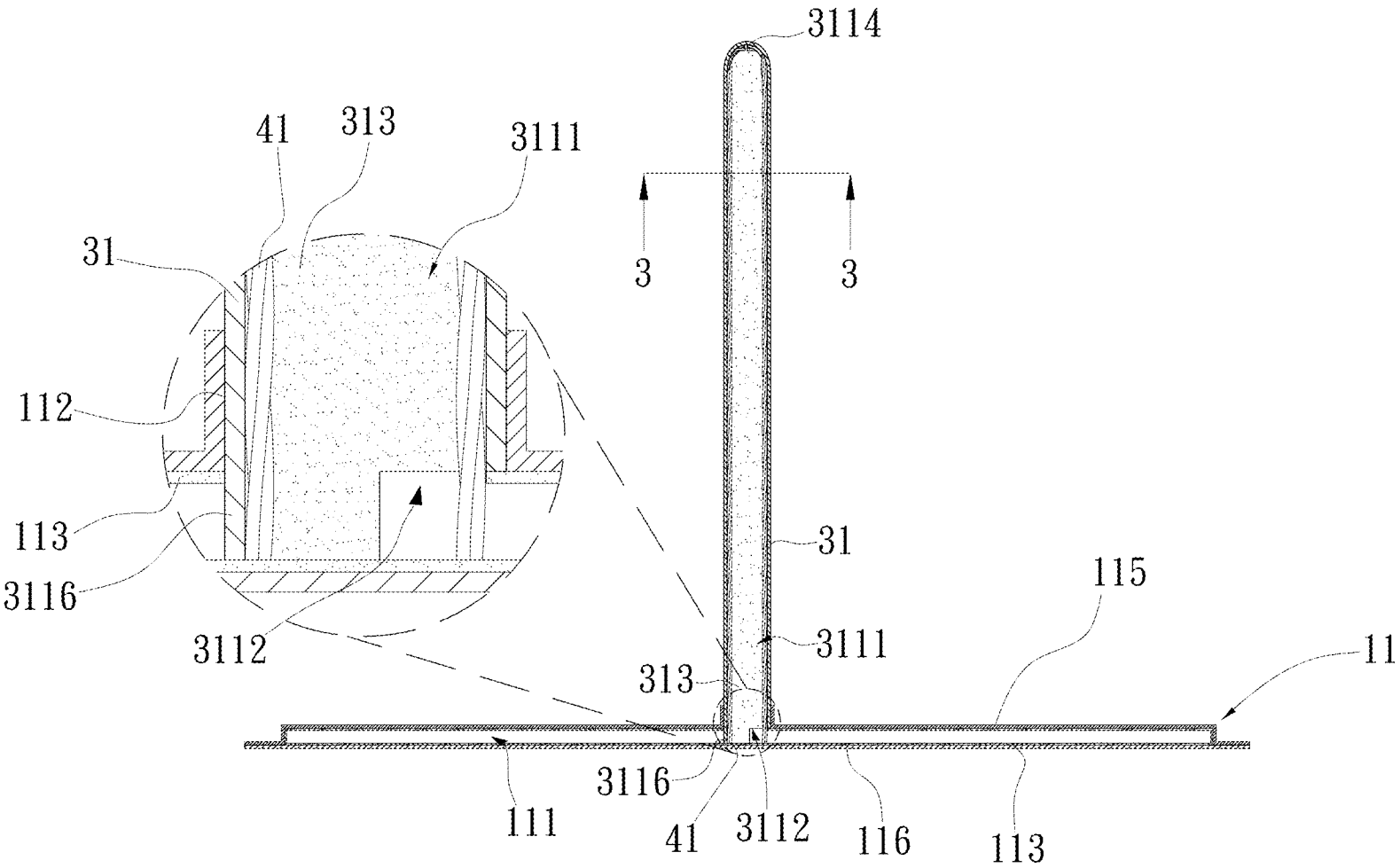
FIG. 2C is a side sectional assembled view of a modified embodiment of the first embodiment of the present invention.
Figure 2D:
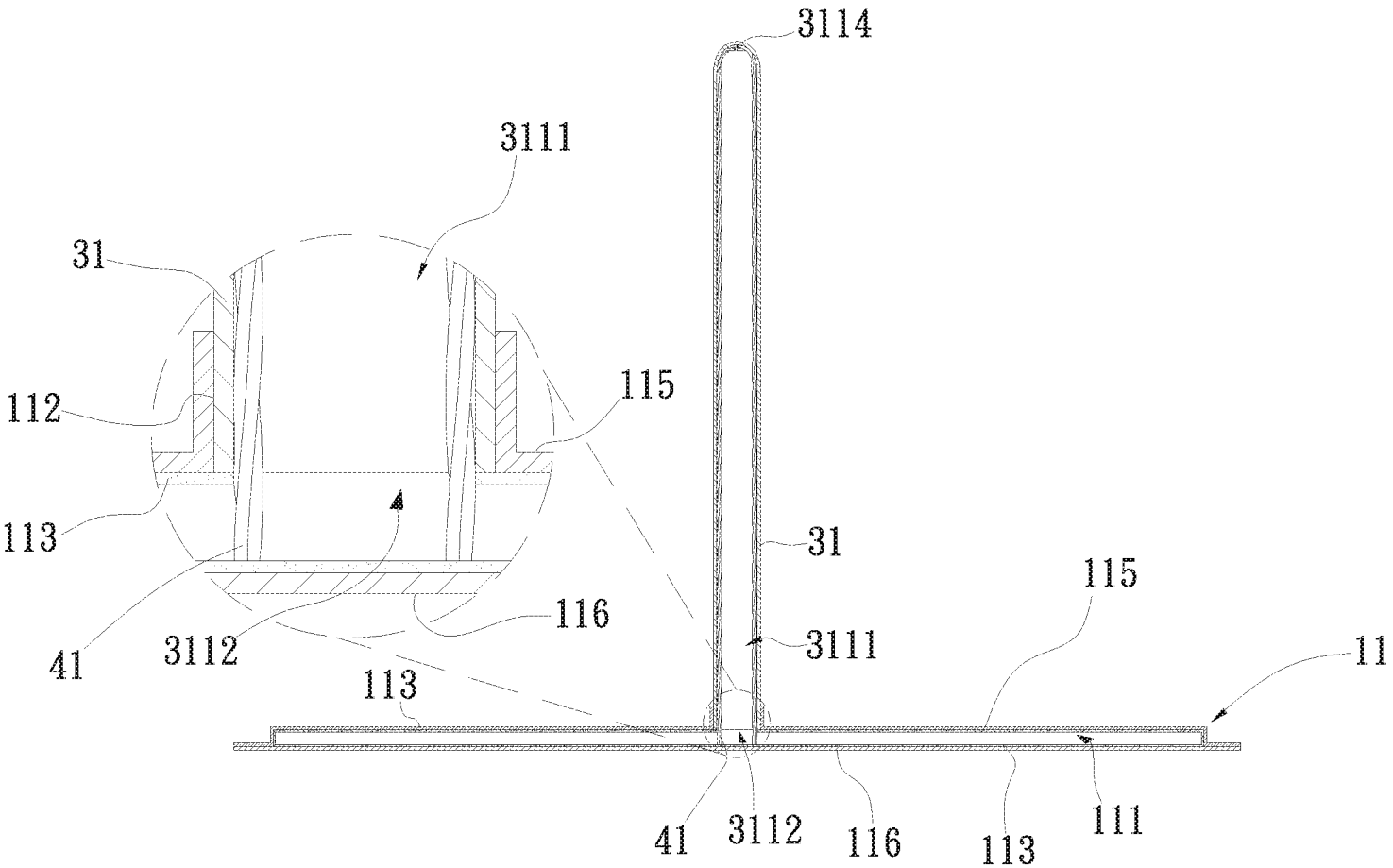
FIG. 2D is a side sectional assembled view of a modified embodiment of the first embodiment of the present invention.
Figure 3A:
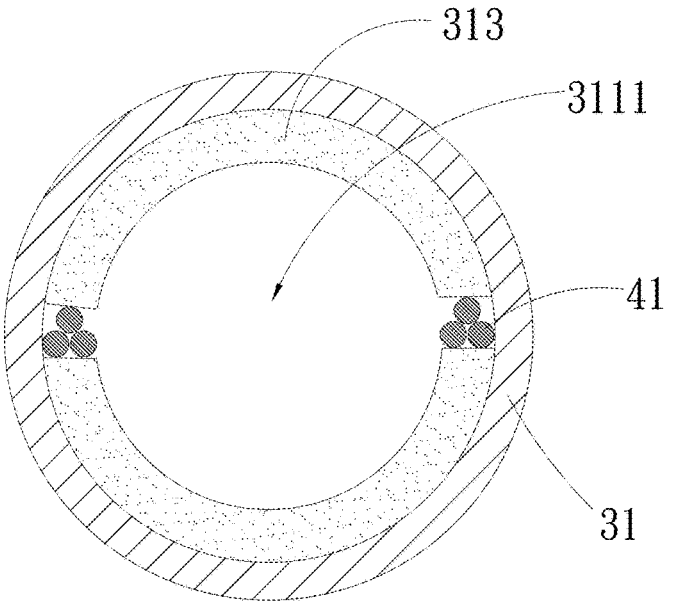
FIG. 3A is a top sectional assembled view of a modified embodiment of the first embodiment of the present invention.
Figure 3B:
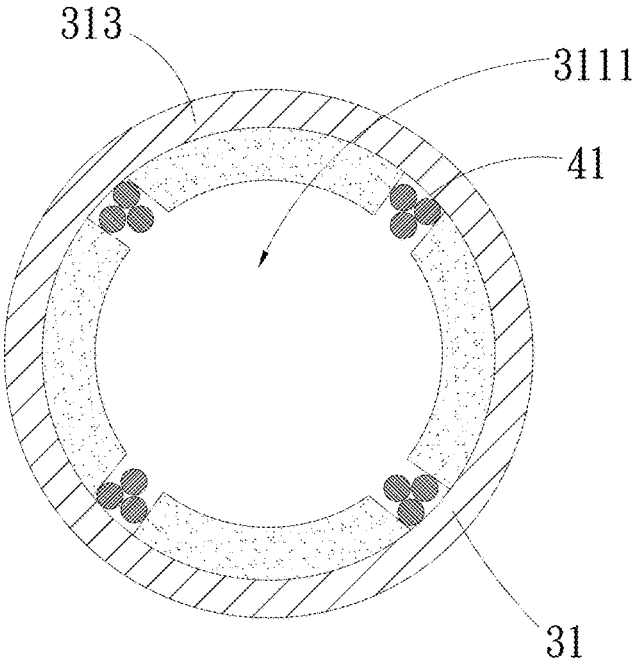
FIG. 3B is a top sectional assembled view of a modified embodiment of the first embodiment of the present invention.

Please refer to FIGS. 1 to 3B. FIG. 1 is a perspective exploded view of a first embodiment of the present invention. FIG. 2 is a perspective assembled view of the first embodiment of the present invention. FIG. 2A is a sectional assembled view of the first embodiment of the present invention. FIG. 2B is a sectional assembled view of a modified embodiment of the first embodiment of the present invention. FIG. 2C is a sectional assembled view of a modified embodiment of the first embodiment of the present invention. FIG. 2D is a sectional assembled view of a modified embodiment of the first embodiment of the present invention. FIG. 3A is a top sectional assembled view of a modified embodiment of the first embodiment of the present invention; and FIG. 3B is a top sectional assembled view of a modified embodiment of the first embodiment of the present invention.

In this embodiment, the case capillary structure 113 is, but not limited to, a sintered powder body formed on the inner wall of the case chamber 111, (that is, on the top side 115 and the bottom side 116 in the case chamber 111). In practice, the case capillary structure 113 disposed in the case chamber 111 can be alternatively a mesh body, a fiber, a channeled body, a whisker or any combination thereof. The opening 112 is formed through the top side 115 of the case 11 in communication with the case chamber 111. In this embodiment, there is one opening 112. In practice, the number of the openings 112 can be more than one. The number of the openings 112 is equal to the number of the tubular bodies 31 (such as heat pipes). In this embodiment, the tubular body 31 is a heat pipe. The tubular body 31 has at least one axial capillary structure 41, an open end 3112 and a closed end 3114 opposite to the open end 3112. The open end 3112 and the closed end 3114 together define a tubular body chamber 3111 positioned between the open end 3112 and the closed end 3114 in communication with the open end 3112. The open end 3112 of the tubular body 31 is directly plugged into the opening 112 of the case 11. The outer circumference of the tubular body 31 is tightly connected with the inner wall of the opening 112 of the case 11. The tubular body chamber 3111 communicates with the case chamber 111 via the open end 3112. The case chamber 111 is, but not limited to, in communication with the tubular body chamber 3111.

A connection section 3116 integrally extends from the open end 3112. The connection section 3116 extends into the case chamber 111 to directly abut against the bottom side 116 of the case 11. In addition, a notch or an opening is formed between the open end 3112 and the connection section 3116. The connection section 3116 is a part of the tubular body 31. The inner circumference of the connection section 3116 is exactly the inner circumference of the tubular body 31. Therefore, the connection section 3116 of the tubular body 31 is connected with the bottom side 116 in the case chamber 111 and the outer circumference of the tubular body 31 is connected with the inner wall of the opening 112 to form a support structure for the case chamber 111. Accordingly, it is unnecessary to provide (or there is not) any support copper column in the case chamber 111 connected between the top side 115 and the bottom side 116. This can achieve cost-saving effect.

Moreover, in this embodiment, the axial capillary structure 41 is formed of multiple fiber threads (such as metal material or nonmetal material of glass, fiber carbon or polymer fiber threads), which are stranded to form dense (or solid) axial capillary structure for providing excellent axial capillary attraction. In practice, the axial capillary structure 41 can be selected from a group consisting of fiber bundle, braid, channeled body and any combination thereof. It should be noted that the axial capillary structure of the present invention can be any capillary structure capable of providing axial capillary transfer effect for the working fluid. The axial capillary structure 41 is disposed on the inner circumference of the tubular body 31 and distributed in the longitudinal (or axial) direction of the tubular body 31 to directly abut against and connect with the case capillary structure 113 disposed on the bottom side of the case in the case chamber 111. In this embodiment, there are multiple axial capillary structures 41 axially extending from the inner side of the tubular body 31 in adjacency to the closed end 3114 to the connection section 3116. The axial capillary structures 41 directly contact and connect with the case capillary structure 113 disposed on the bottom side 116 of the case in the case chamber 111. Also, the axial capillary structures 41 contact and connect with the case capillary structure 113 disposed on the top side of the case in the case chamber 111 in adjacency to the opening. Therefore, the axial capillary structures 41 are disposed on the inner circumference of the tubular body chamber 3111 of the tubular body 31 in the longitudinal or axial direction of the tubular body 31 to provide axial capillary attraction. Under the axial capillary attraction of the axial capillary structures 41, the cooled working fluid (the liquid working fluid) will quickly axially flow back to the bottom side 116 in the case chamber 111. Accordingly, the working fluid can more efficiently flow in axial direction to achieve better heat dissipation effect. In addition, the axial capillary structures 41 axially disposed in the tubular body 31 serve as an axial capillary transfer path for the liquid working fluid, whereby the capillary transfer force for the liquid working fluid is enhanced to achieve better capillary transfer effect. In a preferred embodiment, the number of the axial capillary structures 41 can be previously adjusted in accordance with the heat dissipation requirement, the size of the tubular body 31 and the capillary transfer efficiency. For example, one or more axial capillary structures 41 are disposed on the inner circumference of the tubular body chamber 3111 of the tubular body 31. In another embodiment, a whisker structure or an oxide coating (such as hydrophilic coating) is disposed on the axial capillary structures 41.

As shown in FIG. 2D, in a modified embodiment, the connection section 3116 of the tubular body 31 is saved so as to increase the space (or vapor space) of the case chamber 111 for the liquid working fluid to flow. In still another modified embodiment, the case capillary structure 113 disposed on the top side 115 of the case 11 in the case chamber 111 can be saved and the case capillary structure 113 is simply disposed on the bottom side 116 of the case 11 in the case chamber 111 in direct contact with the axial capillary structures 41.

The application of the present invention is exemplified as follows:

The outer surface of the bottom side 116 of the case 11 is attached to a heat generation component (such as a central processing unit or MCU or any other electronic component necessitating heat dissipation) of an electronic apparatus (such as a computer, a notebook, an intelligent mobile device or a communication device, not shown), the bottom side 116 of the case 11 will absorb the heat generated by the heat generation component. At this time, the working fluid of the case capillary structure 113 on the bottom side 116 in the case chamber 111 will be heated and evaporated and converted into evaporated working fluid (or vapor working fluid). The vapor working fluid will flow to the top side 115 in the case chamber 111. Also, part of the vapor working fluid will pass through the open end 3112 of the tubular body 31 to flow into the tubular body chamber 3111. Then the vapor working fluid on the top side 115 in the case chamber 111 and at the closed end 3114 in the tubular body chamber 3111 is condensed and converted into cooled working fluid (liquid working fluid). Then, under the axial capillary attraction of the axial capillary structures 41, the cooled working fluid at the closed end 3114 in the tubular body chamber 3111 quickly axially flows back to the case capillary structure 113 on the bottom side 116 in the case chamber 111. Therefore, the vapor-liquid circulation of the working fluid continuously takes place within the case chamber 111 and the tubular body chamber 3111 to achieve better heat dissipation effect and better capillary transfer efficiency and enhance the heat transfer efficiency.

As shown in FIG. 2B, in a modified embodiment, a tubular body capillary structure 313 is disposed in the tubular body 31. In this embodiment, the tubular body capillary structure 313 is, but not limited to, a sintered powder body. In practice, the tubular body capillary structure 313 can be alternatively a mesh body, a fiber body, a channeled body, a whisker or any combination thereof. The tubular body capillary structure 313 is formed on the inner circumference of the tubular body chamber 3111 of the tubular body 31. The axial capillary structures 41 are disposed on the surface of the tubular body capillary structure 313 on the inner circumference of the tubular body 31 in contact and connection with the tubular body capillary structure 313. In addition, the tubular body capillary structure 313 and the axial capillary structures 41 at the open end 3112 of the tubular body 31 on the inner circumference of the tubular body 31 are in contact and connection with the case capillary structure 113 on the top side 115 and bottom side 116 in the case chamber 111. The axial capillary structures 41 provide axial capillary attraction for part of the cooled working fluid absorbed by the tubular body capillary structure 313, whereby the part of cooled working fluid will only specifically quickly flow in axial direction back to the case capillary structure 113 on the bottom side 116 in the case chamber 111. Also, under the capillary attraction of the tubular body capillary structure 313, the other part of cooled working fluid will flow back to the case capillary structure 113 on the bottom side 116 in the case chamber 111 in axial direction and radial direction. During the process, under the radial capillary attraction of the tubular body capillary structure 313, the cooled working fluid absorbed by the tubular body capillary structure 313 is transferred to the adjacent axial capillary structures 41. Accordingly, the axial capillary structures 41 simply provide axial capillary transfer path for the working fluid and the tubular body capillary structure 313 provides both axial and radial capillary transfer path for the working fluid. Therefore, better capillary transfer effect is achieved and the vapor-liquid circulation efficiency is enhanced.

As shown in FIGS. 2C, 3A, and 3B, in still another modified embodiment, the tubular body capillary structure 313 is alternatively disposed on one side or two sides of each axial capillary structure 41. In this embodiment, the tubular body capillary structure 313 is formed on two sides of each axial capillary structure 41 (or between each two adjacent axial capillary structures 41) on the inner circumference of the tubular body 31. The tubular body capillary structure 313 is in contact and connection with one side of each adjacent axial capillary structure 41 on the inner circumference of the tubular body 31. In addition, the tubular body capillary structure 313 and the axial capillary structure 41 are adjacently alternately disposed on the inner circumference of the tubular body 31. The tubular body capillary structure 313 and the axial capillary structures 41 at the open end 3112 of the tubular body 31 on the inner circumference of the tubular body 31 are in contact and connection with the case capillary structure 113 on the top side 115 and bottom side 116 in the case chamber 111. Accordingly, the axial capillary structures 41 simply provide axial capillary transfer path for the working fluid and the tubular body capillary structures 313 provide both axial and radial capillary transfer path for the working fluid. Therefore, better capillary transfer effect is achieved and the vapor-liquid circulation efficiency is enhanced.

Therefore, the heat dissipation unit with axial capillary structure of the present invention is able to achieve better capillary transfer effect and enhance the heat dissipation efficiency.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A heat dissipation unit comprising:

a case defining a case chamber and an opening formed through a top side of the case in fluid communication with the case chamber;

a case capillary structure formed in the case chamber;

a tubular body extending away from the case and with an open end and a closed end opposite to the open end, wherein the open end is connected and sealed to the case at the opening such that the open end and the closed end together define a tubular body chamber in fluid communication with the case chamber and the open end;

at least two tubular body capillary structures, each formed on an inner circumference of the tubular body with only a single surface of each tubular body capillary structure in contact with the inner circumference of the tubular body and each tubular body capillary structure spaced apart from the other tubular body capillary structure so as to define at least two side gaps between the at least two tubular body capillary structures;

at least two elongate axial capillary structures, each formed on the inner circumference of the tubular body with only a single surface of each elongate axial capillary structure in contact with the inner circumference of the tubular body and each elongate axial capillary structure respectively disposed in a respective side gap such that each elongate axial capillary structure circumferentially abuts against two adjacent tubular body capillary structures and circumferentially alternates therewith, each elongate axial capillary structure formed of multiple stranded fiber threads along a longitudinal axis of the tubular body such that the tubular body capillary structures and the axial capillary structures are connected with the case capillary structure disposed on a bottom and on a top side of the case in the case chamber; and a working fluid filled in the case chamber and the tubular body chamber, wherein the axial capillary structures provide supplemental axial capillary attraction for a part of the working fluid absorbed by the tubular body capillary structures to flow in an axial direction back to the case capillary structure on the bottom side in the case chamber.

2. The heat dissipation unit of claim 1, wherein the opening is formed at a central position of a side of the case.

3. The heat dissipation unit of claim 1, wherein the tubular body extends perpendicular to a major plane of the case.

4. The heat dissipation unit of claim 1, wherein each axial capillary structure extends completely between the open and closed ends.

5. The heat dissipation unit of claim 1, wherein the axial capillary structures are equally spaced apart from each other.

6. The heat dissipation unit of claim 1, wherein each axial capillary structure is selected from a group consisting of fiber bundle, braid, and a combination thereof.

* * * * *